United States Patent [19]

McGeary

[11] 4,340,269

[45] Jul. 20, 1982

[54] COAXIAL ELECTRICAL CONNECTOR

[75] Inventor: Peter G. McGeary, Burbank, Calif.

[73] Assignee: International Telephone and Telegraph Corporation, New York, N.Y.

[21] Appl. No.: 146,284

[22] Filed: May 5, 1980

[51] Int. Cl.[3] ..... H01R 13/625; H01R 13/639

[52] U.S. Cl. ..... 339/90 C; 339/177 E

[58] Field of Search ..... 339/89 C, 90 C, 177 R, 339/177 E

[56] References Cited

U.S. PATENT DOCUMENTS

| | | | |
|---|---|---|---|
| 2,400,351 | 5/1946 | Hart | 339/90 C X |
| 2,540,012 | 1/1951 | Salati | 339/177 R X |
| 3,701,086 | 10/1972 | Somerset | 339/89 C X |

*Primary Examiner*—Eugene F. Desmond

*Attorney, Agent, or Firm*—Thomas L. Peterson

[57] ABSTRACT

A coaxial electrical connector is disclosed of the type in which a bayonet coupling nut on one connector member mates with bayonet pins on the mating connector member. A rotatable ring on the one connector member has a threaded engagement with the bayonet coupling nut. The wave spring normally associated with a bayonet coupling nut is eliminated. After the nut is engaged with the mating connector member, the ring is rotated to shift the connector shell or outer conductor forwardly until it bottoms out against the mating shell thereby extending the upper frequency limit of the connector.

4 Claims, 3 Drawing Figures

COAXIAL ELECTRICAL CONNECTOR

BACKGROUND OF THE INVENTION

The present invention relates generally to a coaxial electrical connector and, more particularly, to such a connector embodying a bayonet coupling arrangement.

Bayonet coupling arrangements are commonly utilized on coaxial electrical connectors to permit rapid engagement and disengagement of the connector members. Normally a wave spring is utilized in the plug connector member to exert a rearward bias on the bayonet coupling nut thereon so that a resilient but slightly loose mechanical connection is made between the shells of the mating connector members. The somewhat loose mechanical connection between the mating connector members may result in leakage and loss of electromagnetic energy, particularly if the connector is subjected to high degrees of vibration. Thus, coaxial connectors embodying bayonet coupling arrangements are normally utilized only for relatively low frequency application.

For high frequency applications, it is desirable to utilize coaxial connectors of the type having a threaded coupling engagement between the coupling nut on one connector member and the shell of the mating connector member so that the shells may be caused to abut when the connector members are mated thereby providing an uninterrupted continuous electromagnetic path both axially and circumferentially to suppress electromagnetic energy leakage and to maximize energy transfer through the connector.

Systems engineers are often compelled to utilize coaxial plug connector members having bayonet coupling nuts thereon to mate with bayonet pin-type receptacle connector members mounted on electronic black boxes even though the electronics require operation at higher frequency ranges than is practical for the bayonet coupling arrangement of the coaxial connector. That is, the black box manufacturer often utilizes inappropriate coaxial connector receptacle members for the particular application for which the electronics are designed. U.S. Pat. No. 4,037,909 discloses a coaxial electrical connector having a bayonet coupling nut thereon which is designed to prevent the leakage and loss of energy and, therefore, could be used in the foregoing situations. In such connector, the shell in the plug connector member is extended forwardly over the slots in an axially slotted spring outer conductor which makes resilient connection with the shell of the mating receptacle connector member. However, the bowed outer ends of the springs of the outer conductor are not covered by a continuous shield so that the slots therein may still result in some radiation and loss of energy. Also, the connection between the outer conductors of the mating connector members is a sliding resilient connection, rather than a firm abutting mechanical engagement which is preferred for high frequency applications.

It is, therefore, the object of the present invention to provide a coaxial electrical connector having a bayonet coupling arrangement thereon in which the outer conductors of the connector members abut each other when the connector members are mated, thereby providing an uninterrupted continuous electromagnetic path both axially and circumferentially through the outer conductors of the connector so that electromagnetic energy and radiation leakage is eliminated and optimum electromagnetic fields are produced providing maximum energy transfer through the connector.

SUMMARY OF THE INVENTION

According to a principal aspect of the present invention, there is provided an electrical connector member for a coaxial cable having inner and outer conductors. The connector member comprises a conductive shell having a forward mating end and a rear termination end adapted to be connected to the outer conductor of the cable. An insulator in the shell contains a center contact adapted to be connected to the inner conductor of the cable. A ring is rotatably mounted on the shell behind a rotatable bayonet coupling nut thereon. The ring embodies a forwardly facing shoulder engaging a rearwardly facing shoulder on the shell. The ring and nut have a threaded connection therebetween so that rotation of the ring in one direction will cause the shell and nut to move axially toward each other after the nut is coupled to a mating connector member.

As a consequence, when the electrical connector member as just described is connected with a mating connector member and the ring is rotated in said one direction, the shell in the first connector member will move forwardly relative to the bayonet coupling nut to bring the front face of the shell into abutting engagement with a forwardly facing surface on the shell of the mating connector member. Thus, an uninterrupted continuous electromagnetic path is produced between the shells of the connector assembly, as in those coaxial connectors having threaded coupling nuts, but in this instance, in a connector having a quick disconnectable bayonet coupling arrangement.

DESCRIPTION OF THE PREFERRED EMBODIMENT

Figure 2:
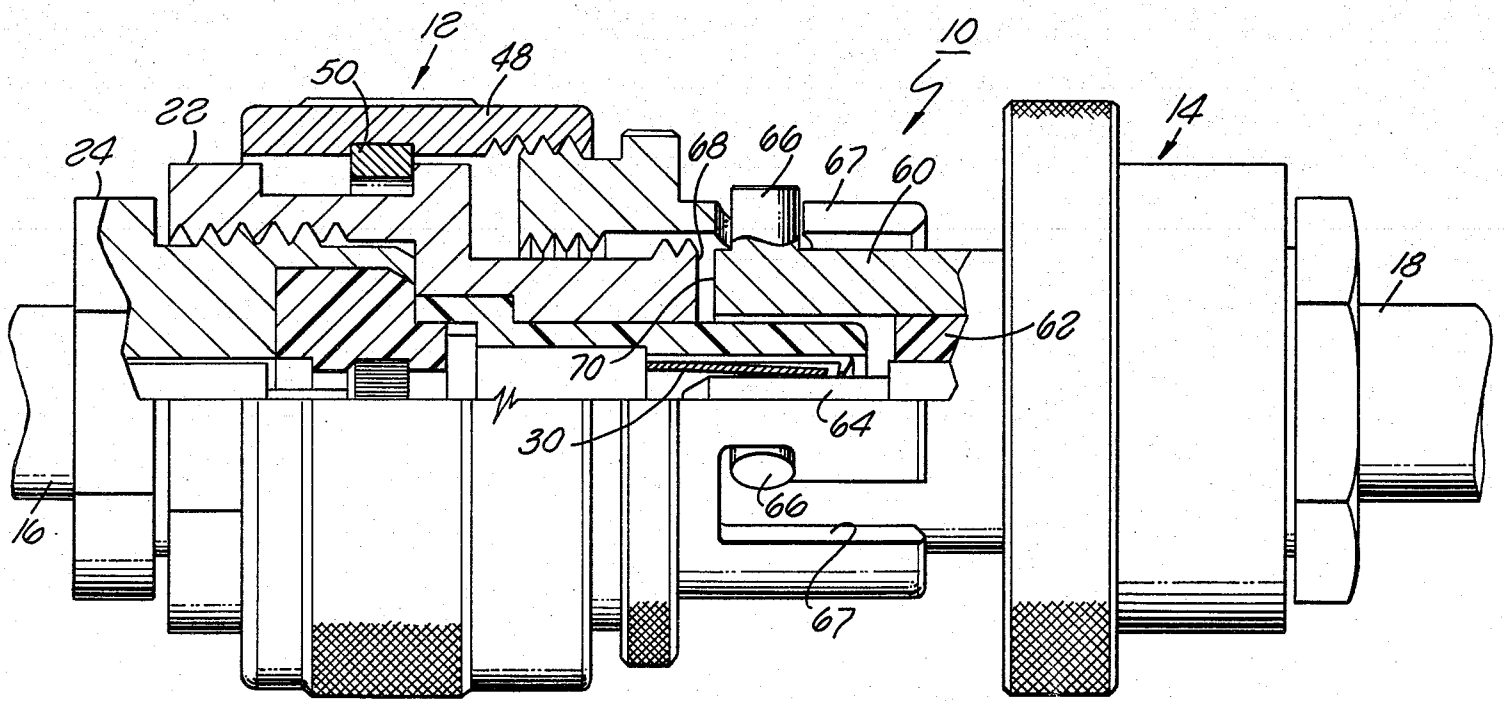
FIG. 2 is a partial longitudinal sectional view of the plug connector member initially engaged with the mating receptacle connector member.
Figure 3:
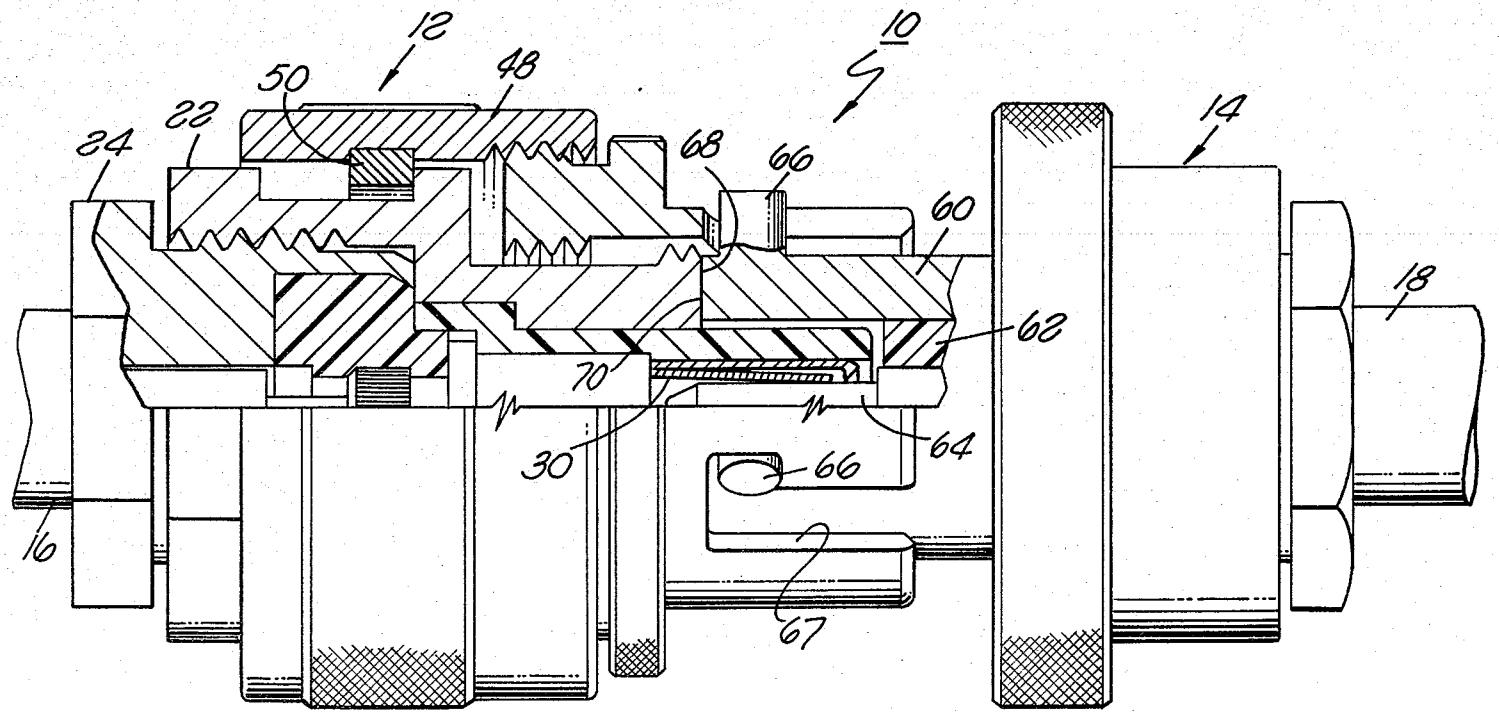
FIG. 3 is a longitudinal sectional view similar to FIG. 2 but showing the plug and receptacle connector members fully interengaged.

As seen in FIGS. 2 and 3, the coaxial electrical connector of the present invention, generally designated 10, comprises a plug connector member 12 and a mating receptacle connector member 14, each connected to coaxial cables 16 and 18, respectively.

Figure 1:
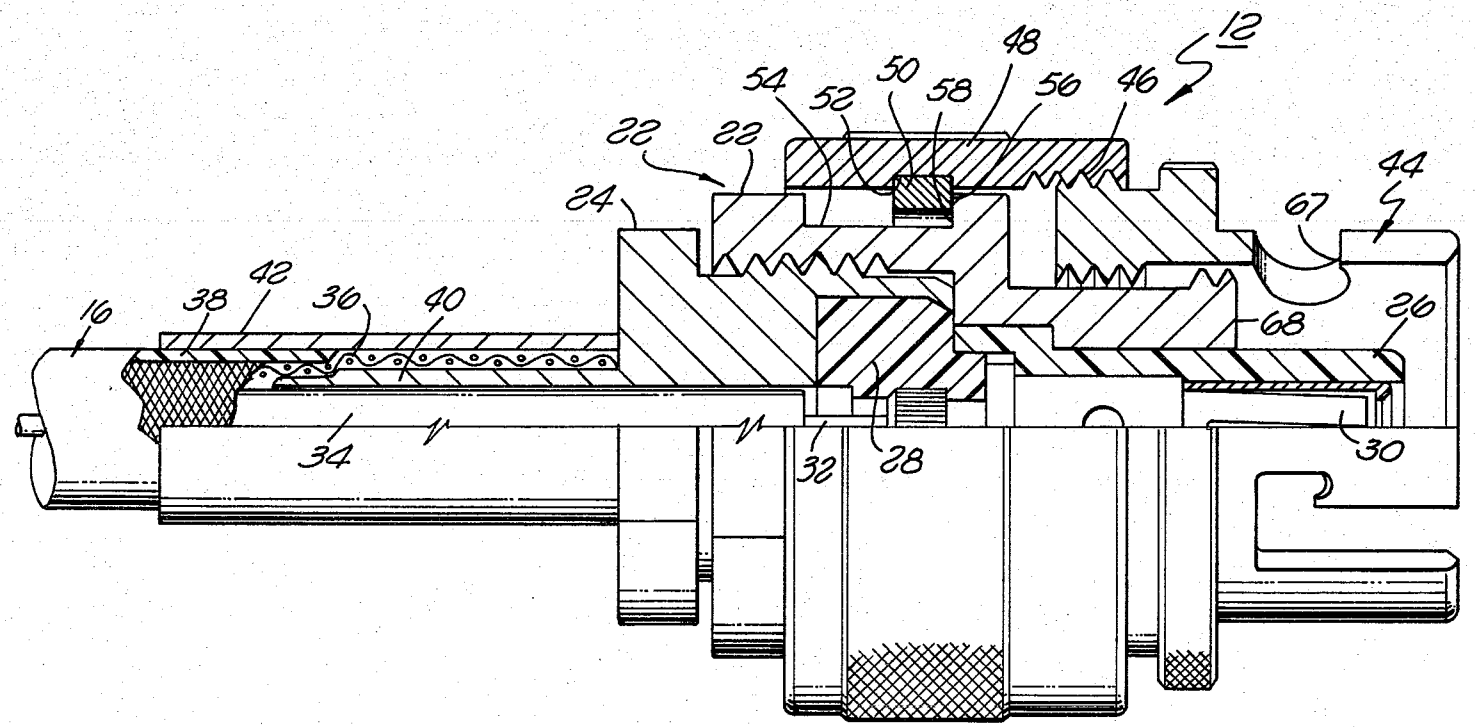
FIG. 1 is a partial longitudinal sectional view through the plug connector member of the present invention.

As best seen in FIG. 1, the plug connector member 12 comprises a conductive shell, generally designated 20, which consists of a front part 22 and rear part 24. The front part of the shell contains a front insulator 26 while the rear part 24 contains a resilient rear insulator 28. The rear part of the shell is threaded into the front part thereof to retain the front and rear insulators therein. A center contact 30, shown as being a female or socket contact, is connected to the inner conductor 32 of the cable 16. The insulating core 34 of the cable is surrounded by a metal cable braid or outer conductor 36. The outer conductor is surrounded by an outer insulator jacket 38. The core of the cable extends into the rear part 24 of the shell through an inner crimp sleeve 40 which extends rearwardly from and is integral with the part 24. The outer conductor 36 is disposed between the inner crimp sleeve 40 and an outer crimp sleeve 42. The insulator jacket 38 extends a short distance into the space between the crimp sleeves. The sleeves are crimped to mechanically and electrically connect the outer conductor 36 of the cable to the connector shell 20. The structure described so far is generally conventional and constitutes no part of the present invention.

In accordance with the present invention, a bayonet coupling nut 44 has at its rear end a threaded connection, as indicated at 46, to the interior of a ring 48 which is rotatably mounted on the shell 20. The ring 48 is retained on the shell 20 by means of a retaining ring 50 which extends into an annular groove 52 in the interior of the ring 48 and into an annular groove 54 in the outer surface of the shell 20. The retaining ring 50 provides a forwardly facing annular shoulder 56 which engages a rearwardly facing annular shoulder 58 formed by the front edge of the groove 54.

The mating receptacle connector member 14 comprises a conductive shell 60 surrounding an insulator 62 which contains a center pin contact 64. The shell 60 and pin contact 64 are connected to the inner and outer conductors, respectively, of the coaxial cable 18 in a manner similar to the connection of the inner and outer conductors of the plug connector member 12 to the inner and outer conductors of the coaxial cable 16 illustrated in FIG. 1.

When the plug and receptacle connector members are initially mated, bayonet pins 66 on the shell 60 of the receptacle connector member enter the bottoms of the bayonet slots 67 in the coupling nut 44 on the plug connector member as in any conventional bayonet coupling arrangement. As explained previously herein, a bayonet coupling arrangement provides a somewhat loose connection, even when a wave spring exerts a rearward bias on the bayonet coupling nut to urge the shells of the mating connector members into engagement. The somewhat loose connection provided by the bayonet coupling arrangement alone is depicted in FIG. 2 by the space between the front face 68 of the shell 20 of the plug connector member and the front face 70 of the shell 60 of the receptacle connector member. In the present invention, the wave spring in the conventional bayonet coupling arrangement is replaced by the ring 48. Hence, after the connector members are initially mated, as seen in FIG. 2, the ring 48 is rotated in a clockwise direction whereby the ring will move forwardly, thereby causing the shell 20 to likewise shift forwardly due to the interengagement between the shoulders 56 and 58 on the retaining ring 50 and shell 20, respectively. The ring 48 is rotated until the front face 68 of the shell 20 firmly abuts against the front face 70 of the shell 60 thereby producing an uninterrupted continuous electromagnetic path both axially and circumferentially through the shells or outer conductors of the connector members. Thus, the novel bayonet coupling arrangement of the present invention eliminates any swivel or pullback as evident in the spring loaded bayonet coupling arrangements of the prior art. Because of the bottoming action of the shells in the connector members, the upper frequency limit of the connector is extended and higher vibration requirements may be met. By way of example, a conventional BNC bayonet-type coaxial plug connector member, which normally has a useable frequency range to 4 GHz, may have its frequency range extended to 11 GHz by incorporating therein the coupling device of the present invention.

What is claimed is:

1. An electrical connector member for a coaxial cable having inner and outer conductors comprising:

a conductive shell having a forward mating end and a rear termination end adapted to be connected to the outer conductor of the cable;

an insulator in said shell containing a center contact adapted to be connected to the inner conductor of the cable;

a ring rotatably mounted on said shell, said ring embodying a forwardly facing shoulder engaging a rearwardly facing shoulder on said shell;

a rotatable bayonet coupling nut in front of said ring; and said ring and nut having a threaded connection therebetween whereby rotation of said ring in one direction will cause said shell and nut to move axially toward each other after said nut is coupled to a mating connector member.

2. An electrical connector member as set forth in claim 1 wherein:

the forward end of said ring is internally threaded and the rear of said nut is externally threaded providing said threaded connection.

3. An electrical connector member as set forth in claim 1 wherein:

overlapping annular grooves are formed in said ring and said shell; and a retaining ring is carried by one of said grooves and extends into the other groove, the front face of said retaining ring and the front edge of said other groove providing said forwardly and rearwardly facing shoulders, respectively.

4. An electrical connector for coaxial cables comprising:

first and second mating connector members each adapted to be connected to a coaxial cable;

each said connector member comprising a conductive shell having an insulator therein containing a center contact matable with the center contact of the other connector member;

said shells having forwardly facing surfaces thereon adapted to abut each other after said connector members are initially mated;

one of said shells having a bayonet coupling nut thereon for connection with bayonet pins on the other shell;

a ring rotatably mounted on said one shell behind said nut, said ring having a forwardly facing shoulder engaging a rearwardly facing shoulder on said one shell; and said ring and nut having a threaded connection therebetween whereby rotation of said ring in one direction will cause said shell surfaces to abut after said connector members are initially mated by engagement of said bayonet pins with said nut.

* * * * *